US006516760B2

(12) United States Patent
Buglioni

(10) Patent No.: US 6,516,760 B2
(45) Date of Patent: Feb. 11, 2003

(54) VALVES FOR I.C. ENGINES WITH VARIABLE LIFTS AND TIMINGS

(76) Inventor: Gianluigi Buglioni, Via Capitano Cagni, 24, I-62012 Civitanova, Marche (Macerata) (IT)

( * ) Notice: Subject to any disclaimer, the term of this patent is extended or adjusted under 35 U.S.C. 154(b) by 0 days.

(21) Appl. No.: 09/780,352

(22) Filed: Feb. 12, 2001

(65) Prior Publication Data

US 2001/0013325 A1 Aug. 16, 2001

(30) Foreign Application Priority Data

Feb. 10, 2000 (IT) ..... TO2000A000131

(51) Int. Cl.[7] ..... F01L 1/34; F01L 13/00

(52) U.S. Cl. ..... 123/90.16; 123/90.12; 123/90.48

(58) Field of Search ..... 123/90.12, 90.13, 123/90.15, 90.16, 90.48, 90.49

(56) References Cited

U.S. PATENT DOCUMENTS

| | | | | |
|---|---|---|---|---|
| 4,696,265 A | * | 9/1987 | Nohira | 123/90.16 |
| 4,892,067 A | * | 1/1990 | Paul et al. | 123/90.12 |
| 5,002,022 A | * | 3/1991 | Perr | 123/90.12 |
| 5,839,400 A | * | 11/1998 | Vattaneo et al. | 123/90.16 |

* cited by examiner

*Primary Examiner*—Weilun Lo
(74) *Attorney, Agent, or Firm*—Sughrue Mion, PLLC

(57) ABSTRACT

A variable timing system for i.c. engines, especially for motor vehicles, with suction and/or exhaust valves provided with hydraulic tappets in which the position of the oil inlet passages within the chamber of the hydraulic tappet can be selectively regulated in such a manner as to appropriately vary the moment at which they become closed by the cup member of the tappet, thus either retarding or advancing the opening of the valve i.e. diminishing or increasing its lift continuously from zero to a maximum value.

12 Claims, 10 Drawing Sheets

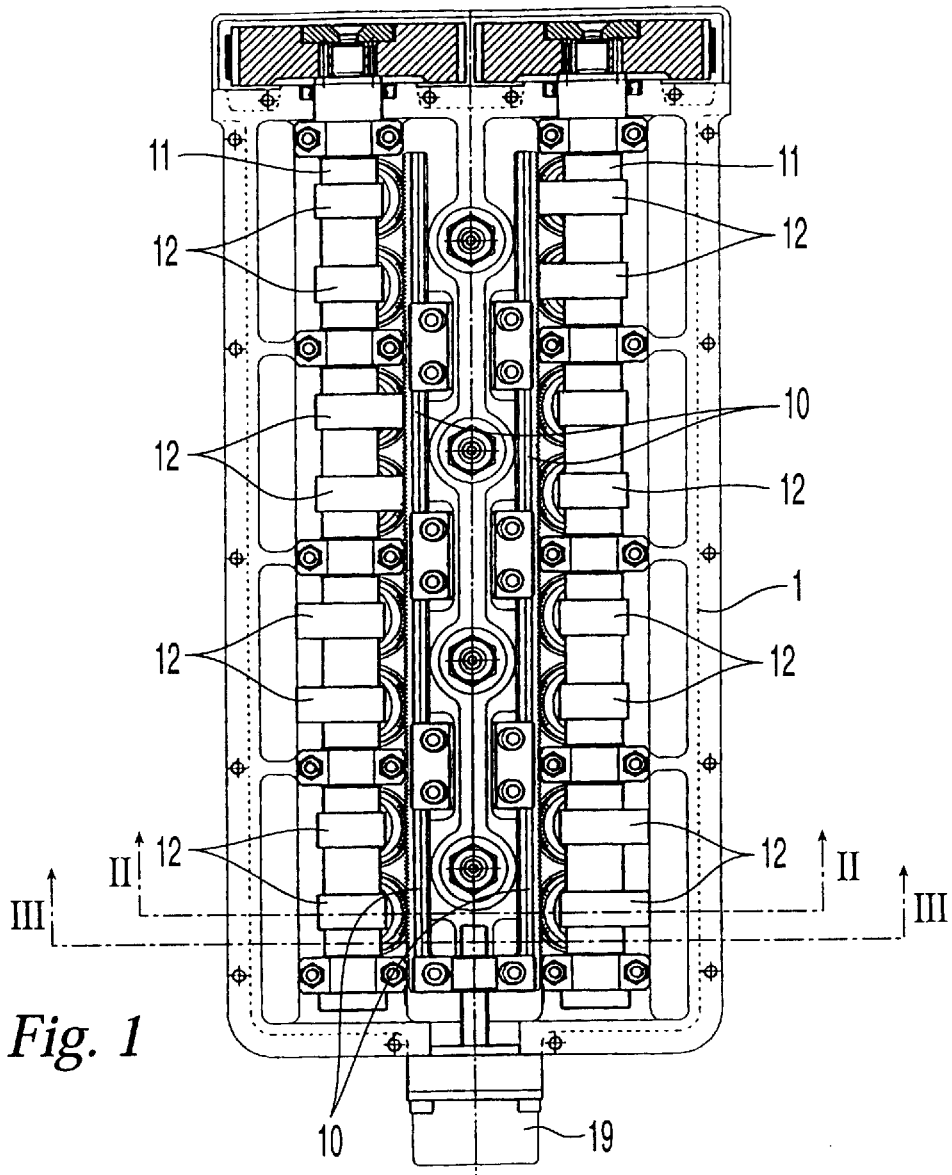
Fig. 1
Fig. 3
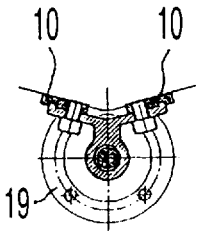
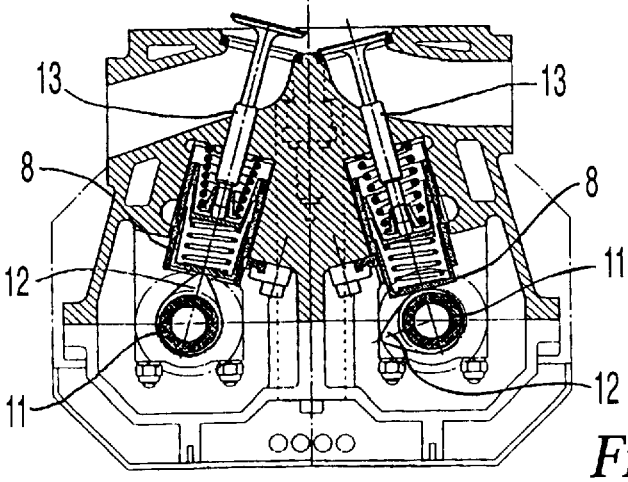
Fig. 2

Fig. 5
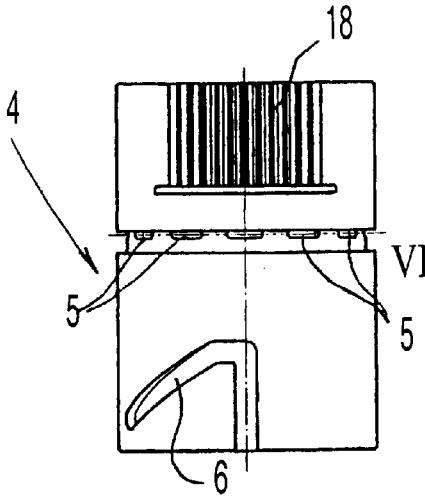
Fig. 6
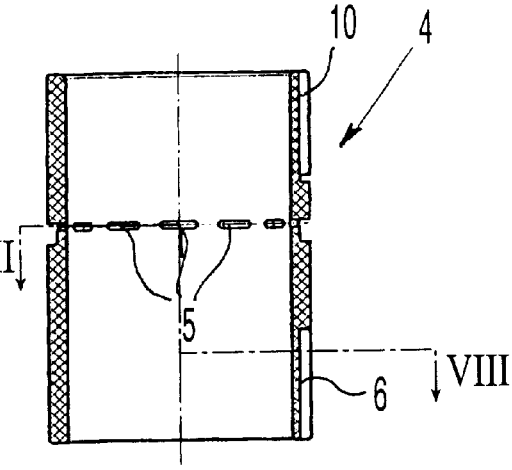
Fig. 7
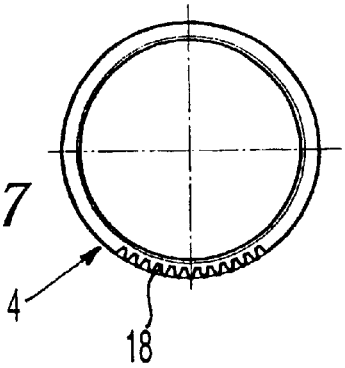
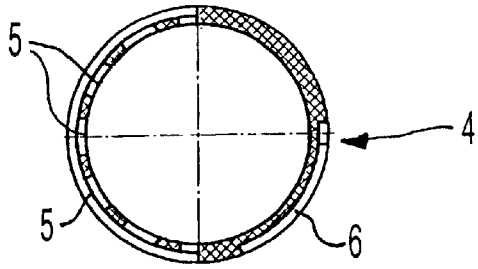
Fig. 8
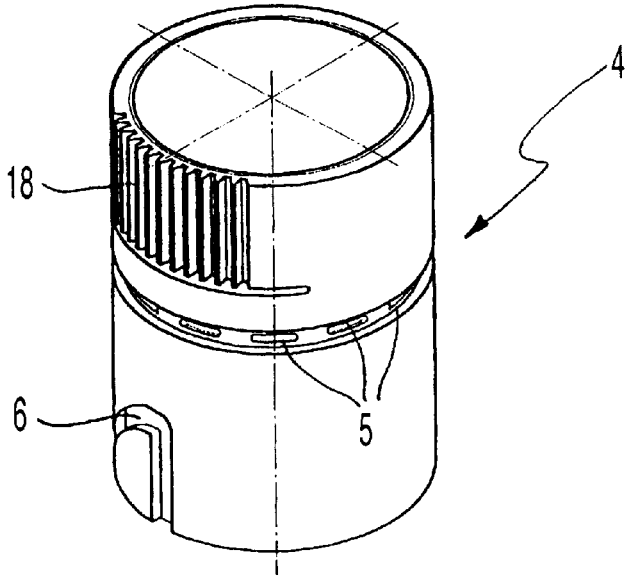
Fig. 9

VALVES FOR I.C. ENGINES WITH VARIABLE LIFTS AND TIMINGS

FIELD OF THE INVENTION

The present invention relates in general to the timing system for internal combustion engines, hereinafter referred to as i.c. engines, especially for motor vehicles, comprising at least one distribution shaft provided with cam means and at least one valve operated by the said cam means.

Recent years have seen motor car research concentrate ever greater interest on obtaining torque curves such as to keep on improving the comfort and elasticity in motion of motor vehicles equipped with this type of i.c. engine. Nevertheless, motor vehicles that are ever more spacious and ever more equipped with safety systems, be they active or passive, and therefore of ever greater weight, together with the need for making more economic use of energy, also call for the highest possible values of the driving torque to be obtained from engines of an ever smaller cubic capacity.

With a view to obtaining all this, the makers of i.c. engines are at present working along two development lines, sometimes at one and the same time.

The first of these envisages a twofold possibility of the distribution diagramme: normally the suction phase is advanced or retarded with respect to the exhaust phase, or a second suction valve is brought into operation at a certain speed of rotation, this with a view to obtaining at least two different distribution patterns in the course of engine use (one more suitable at low rotation regimes, the other for obtaining the maximum power). With this solution, however, one obtains no more than a compromise, because the total valve opening angle, which necessarily remains constant, imposes limits on both the first and the second case.

At low regimes and/or low loads the valve opening is retarded (but, consequently, this also applies as regards its closure) so as to avoid the discharge of unburnt gases in the exhaust phase. But when this is done, the pumping work has to be increased and there is a backflow of the gases already sucked in on account of the low intake speed. As a result one obtains a low volumetric efficiency and a smaller mechanical efficiency.

At higher regimes and loads the opening of the suction valve is advanced to facilitate the filling of the cylinder, but the fact that the closure of this valve is likewise advanced almost wholly excludes the possibility of utilizing the inertia of the fluid column in the intake duct, which would have the effect of producing a higher degree of filling that costs nothing in terms of mechanical losses.

Furthermore, the instantaneous phase variation produces a torque curve that is humped rather than homogeneous, because it is the resultant of two different curves that have apices well apart from each other.

The second line is the one that aims at complicated intake manifolds, designed in such a way that, inserting two or three butterfly valves at particular points and combining the opening of one with the opening and/or closure of the others, there are created different lengths of the intake ducts, each suitable for obtaining the best possible torque, though necessarily only for a limited range of engine rotation regimes, thus exploiting both the inertia of the gases and the pressure waves set up by the opening and closing of the valves. The programmed intervention of these combinations gives rise—always within a particular range of engine rotation regimes—to a more favourable driving torque, but in this case, once again, the resulting curve is not homogeneous and is characterized by two or three humps corresponding to the various maximum values.

At least at low loads and engine rotation regimes, moreover, it has long since become indispensable—and therefore the subject of research—to have a "poor" air-petrol mixture, that is to say, a fuel well below the stoichiometric optimum, and thus to diminish both the specific fuel consumption and atmospheric pollution.

The limit to the degree of poverty is however conditioned by the possibility of igniting the mixture (ignition must remain certain if damage to the catalytic silencer/converter is to be avoided), and ignition becomes more efficient as speed and turbulence become greater in both the intake ducts and the combustion chamber. But at low regimes and/or low loads greater speeds can be obtained only by reducing the passage section.

OBJECT OF THE INVENTION

With a view to obviating the aforesaid disadvantages, the present invention has the purpose of attaining one or more of the objectives listed below:

- Provide a variator for the feed system that will enable the i.c. engine to operate—at all rotation regimes and at all load conditions—with the distribution diagramme and the gas passage section most favourable for obtaining the maximum torque, the minimum specific consumption and the lowest degree of atmospheric pollution.
- Make it possible to vary not only the angles of both the beginning of the opening and the end of the closing of the valves, but also their lifts, in a gradual and continuous manner from zero to the maximum permitted by the cams that produce them.
- When there are several suction valves, make it possible for these valves to operate with different opening times and thus to obtain even at the "minimum" and at very small loads gas speeds sufficiently high to provide adequate turbulence for ensuring ignition and regular functioning and also to satisfy the ever present requirements of low specific consumption and degree of pollution.
- Eliminate the butterfly choking shutter (choke), cause of not by any means negligible pumping losses and therefore overall engine efficiency, especially at low loads, which represent also the most commonly used engine condition.
- Always with a view to reducing the engine's specific consumption, make it possible for the engine to be managed in such manner as to get it to work also with a number of cylinders smaller than their total number when only a limited power is required.
- Obtain from an engine of relatively limited cylinder capacity the same performance associated with one of greater capacity, with corresponding benefits in terms of size, weight and consumption, obtain an appreciable overall efficiency improvement.

SUMMARY OF THE INVENTION

According to the invention, the aforesaid purposes can be obtained by means of the possibility of mechanically varying—either directly or via an electronic control, but in either case connected with the gas control of the i.c. engine—the position of appropriate oil passage holes in appropriately designed hydraulic tappet (valve follower) systems and thus to determine valve lifts and distribution diagrammes that can be gradually and continuously varied from zero to the maximum permitted by the cam and thus to introduce into the cylinder, and also at the most favourable moment, the quantity of air or of air-fuel mixture that is optimal no matter what the required running condition, and this without having to make use of a so-called "butterfly" choke valve.

In greater detail, the invention envisages a timing system of i.c. engines, especially for motor vehicles, comprising at least one distribution shaft provided with cam means, at least one suction or exhaust valve operated by the said cam means, and control means for providing variable lifts and timings of the said valve, in which between the said cam means and the valve there is arranged a hydraulic tappet system including a cup member and a piston delimiting therebetween a chamber that communicates with inlet passage means for feeding oil from a hydraulic circuit, wherein closure of said inlet passage means is performed by the said cup member as a result of displacement thereof towards the said piston operated by the said cam means, characterized by the fact that the position of the said inlet passage means can be selectively regulated in such a way as to correspondingly vary the moment at which they become closed by the said cup member and, consequently, retard or, respectively, advance the opening of the said valve i.e. decrease or increase the lift thereof, respectively.

BRIEF DESCRIPTION OF THE DRAWINGS

The invention will now be described in detail by reference to the attached drawings, which are furnished solely as examples and are not to be considered as limitative in any way, in which:

FIG. 1 shows a schematic plan view of an internal combustion engine for motor vehicles that is equipped with a timing system in accordance with the invention, FIG. 2 shows a view of the transverse of the engine along the line II—II of FIG. 1, FIG. 3 shows a partial view of the section along the line III—III of FIG. 1, FIG. 5 shows a view of a detail of FIG. 4 in side elevation, FIG. 6 shows a vertical section view of FIG. 5, FIG. 7 shows a plan view of FIG. 5 as seen from above, FIG. 8 shows a horizontal section view along the line VIII—VIII, FIG. 9 shows a perspective view of the detail of FIGS. 5–8, FIGS. 10, 11 and 12 show views analogous to those of FIGS. 1, 2 and 3, respectively, of a first variant.

DETAILED DESCRIPTION OF THE INVENTION

Referring for the moment to FIGS. 1 to 3, the invention will now be described by way of example with reference to an i.c. motor-vehicle-type engine with four cylinders, each provided with two suction valves and two exhaust valves. In these figures the reference number 1 generically indicates the cylinder head of the engine with two timing shafts 11 with respective cams 12 for operating respectively the suction valves and the exhaust valves indicated by the reference number 13.

Figure 4:
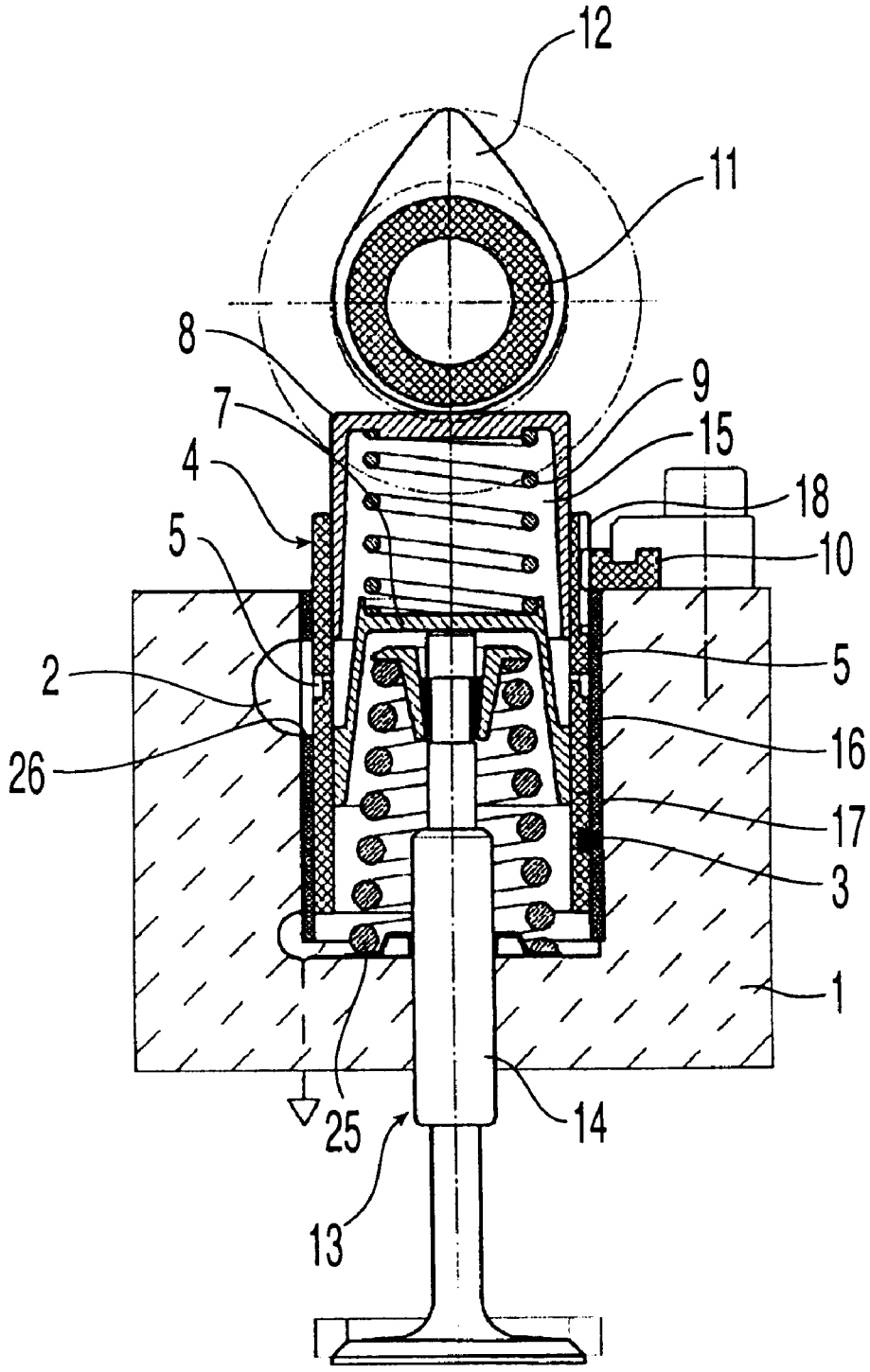
FIG. 4 shows a detail of FIG. 2 to a larger scale and in a reversed position.

The description that follows is referred to one of the suction valves 13, represented in detail in FIG. 4, but can be applied identically to all the other valves of the engine.

The suction valve 13 conventionally comprises a stem 14 that can move in a seating 17 of the cylinder head with which there is associated a hydraulic tappet that will be described in detail by reference to FIG. 4.

The said hydraulic tappet consists of a cup member 8 and a piston or pusher 7 that, together, delimit a chamber 15 connected—in a manner to be explained further on—to an oil passage hole 2 linked to the lubrication circuit of the engine.

The cup member 8 of the hydraulic tappet is in contact with the profile of the appropriate cam 12 of the timing shaft 11, while the piston 7 rests against the end of the stem 14 of the valve 13. Operatively associated with the valve stem 14 is a return device that in the example here illustrated consists of a spring 25 that could, however, be replaced by any equivalent hydraulic or pneumatic arrangement.

Between the cup member 8 and the piston 7 there is interposed a return spring 9 designed for a modest load proportional to the weight of the cup member 8.

The cup member 8 and the piston 7 can slide axially within an annular element 4 that, in its turn, is housed in a stationary socket 16 inserted in the cavity 17.

The annular element 4, which is shown in greater detail in FIGS. 5 to 9, is of a general cylindrical shape and is mounted axially in such a manner as to be capable of sliding and rotating with respect to the socket 16. On its outside it has a helicoidal groove 6 that engages with a fixed pin 3 projecting from the socket 16, and it also bears a circumferential crown of apertures 5. In the case of the example here illustrated, moreover, the annular element 4 is provided with a dented sector 18 that engages with a rack 10 running parallel with the timing shaft 11 and can be linearly displaced by means of an electric stepper (step-by-step) motor 19.

The apertures 5 place the chamber 15 in communication with the oil passage hole 2 through an opening 26 of the stationary socket 16.

Due to the effect of the displacement of the rack 10 that engages with the dented sector 18, the annular element 4 can be made to rotate in either one or the other direction and, thanks to the interaction between the pin 3 and the helicoidal groove 6, it is therefore displaced axially in such a way as to alter the axial position of the apertures 5.

The chamber 15 defined by the cup member 8 of the tappet and the piston 7, the volume of which can be diminished by an appropriate design of its two constituent elements, is therefore occupied by low-temperature oil that enters it from the lubrication circuit through the passage 2, the opening 26 and the circumferential apertures 5 of the annular element 4.

During operation, as soon as the cam 12 begins to displace the cup member 8, the oil contained in the chamber 15 issues from it through the apertures 5 and continues to do so until the moment in which the cup member 8 comes to cover and thus close them in the course of its descent motion: until this point is reached, the valve 13 remains within its seating, but from this point onwards, given the practically complete incompressibility of the liquids at low pressures, the tappet-oil-valve system will behave like a single body and the valve 13 will therefore begin to open as it follows the profile of the cam 12. Given the speed of execution, as also due to the low pressure and the limited play between the component elements, possible oil seepages will not have any negative influence and, if anything, can play a useful part by damping the acceleration peaks.

When the valve 13 returns into its seating, the apertures 5 will again be open and the starting situation becomes re-established.

It is evident that the opening of the valve 13 can be retarded or advanced by varying the axial position of the apertures 5 with respect to the cup member 8 of the tappet, so that the lift of the valve can be adjusted to any desired value in a continuous and gradual manner. In order to obtain this effect, one need do no more than rotate the annular element 4 by means of the rack 10 in either one or the other direction.

Figure 10:
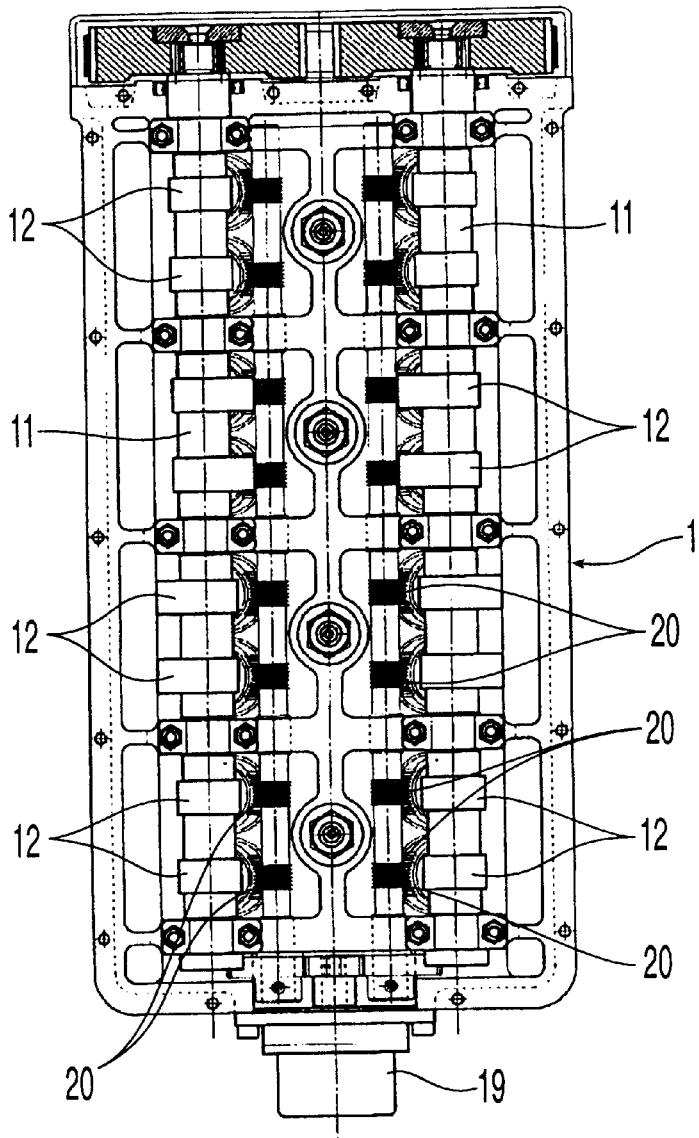
Figure 12:
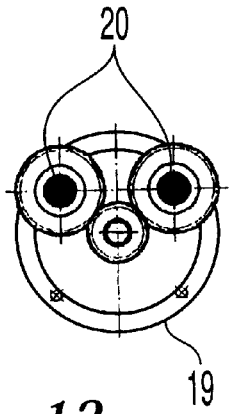
Figure 11:
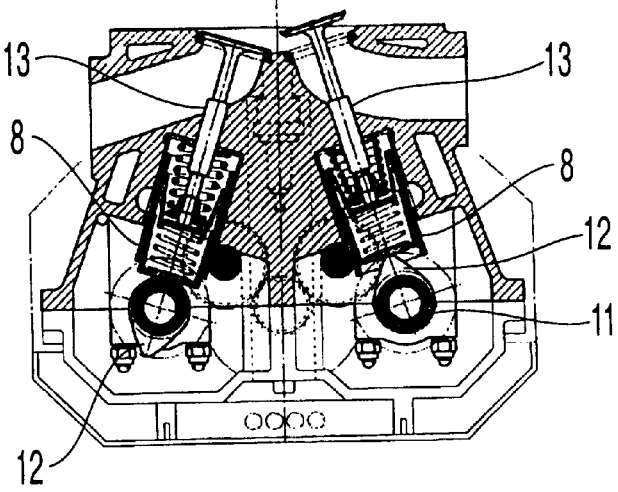

As already noted, in the case of the example illustrated by FIGS. 1 to 3 an electric stepper motor (electronic accelerator) is used to control the translation of the two racks 10 associated with, respectively, the suction valves and the exhaust valves 13 of the engine. In the variant shown in FIGS. 10 to 12 (where parts identical with or similar to the ones already described are indicated by the same reference numbers) the rotation of the annular elements 4 is obtained by means of endless screws 20 controlled in rotation by the electric stepper motor 19

Figure 13:
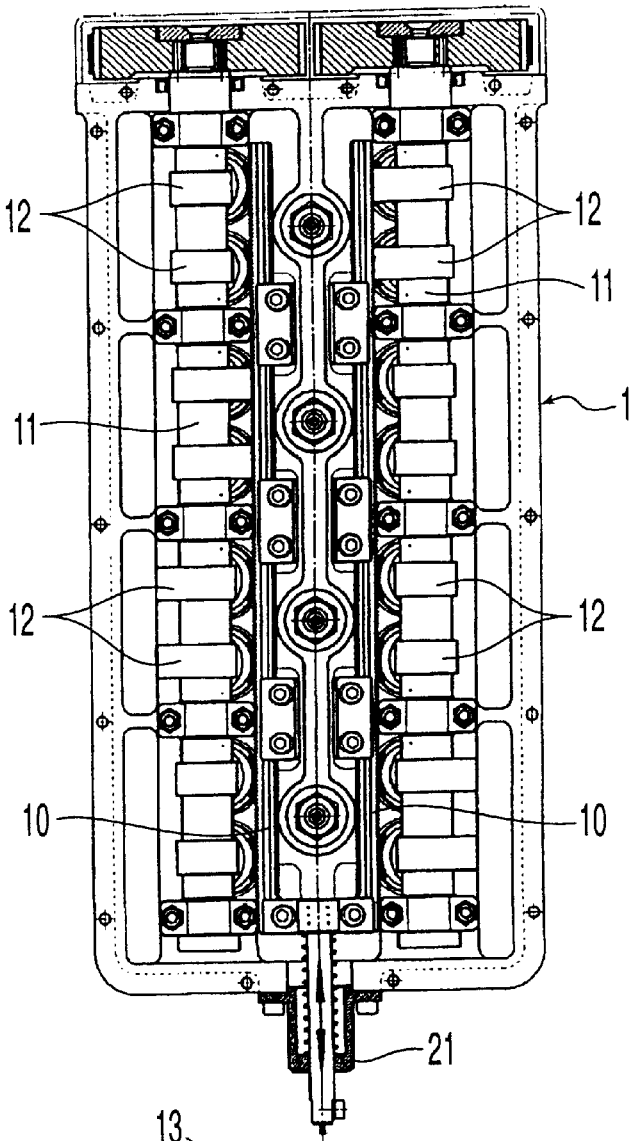
FIGS. 13, 14 and 15 show views analogous to those of FIGS. 1, 2 and 3, respectively, of a second variant.
Figure 15:
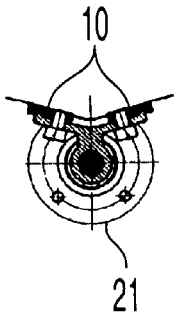
Figure 14:
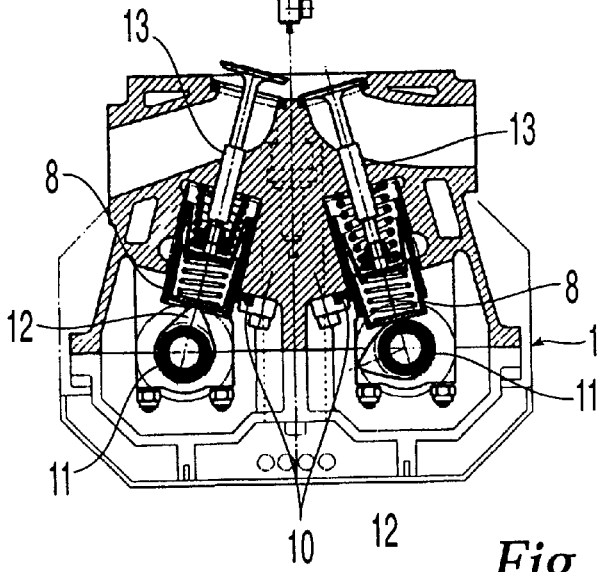

In the variant shown in FIGS. 13 to 15, on the other hand, the linear displacement of the rack 10 is obtained by means of a linear actuator 21, which may be of either the mechanical or the hydraulic type.

Figure 16C:
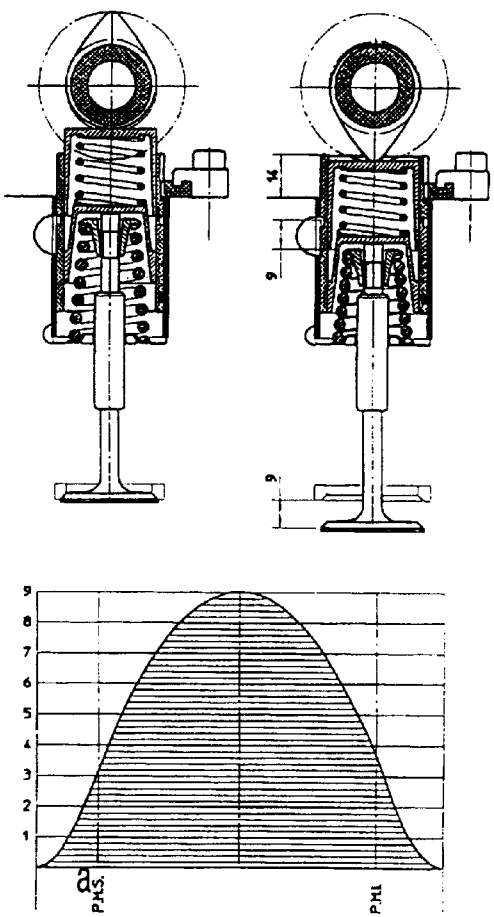
FIGS. 16*a*, 16*b*, and 16*c* show diagrammes of the lifts and the opening and closing angles of the valves of the timing system in accordance with the invention.
Figure 16B:
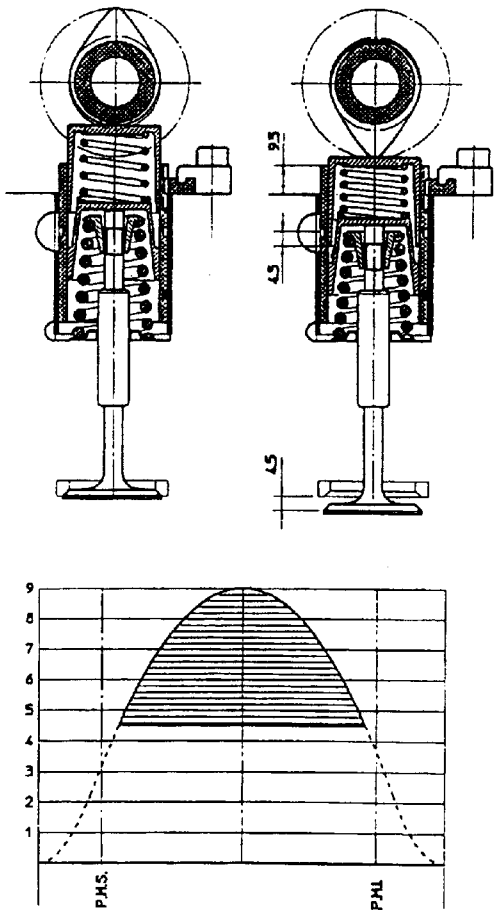
Figure 16A:
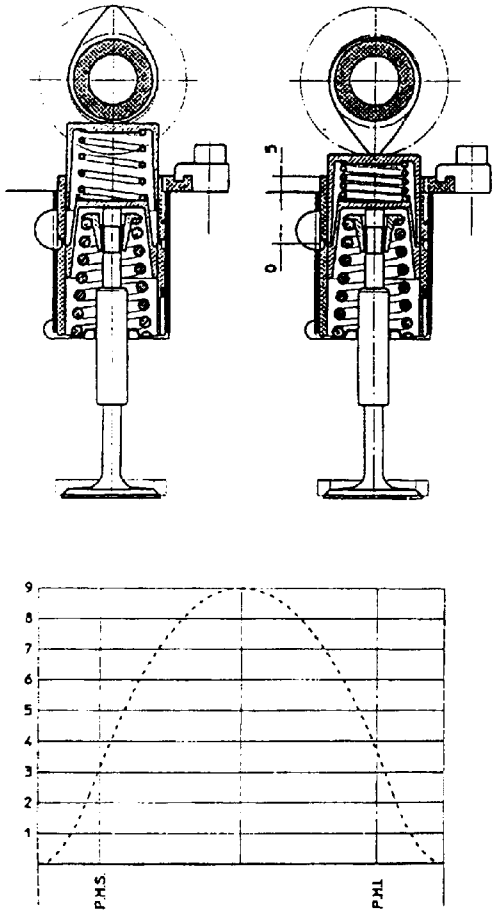

FIGS. 16*a*, 16*b* and 16*c* illustrate the variations of the lift and the opening and closing angles of the valves 13 as a function of the axial positions of the of the annular elements 4 at, respectively, zero lift (FIG. 16*a*), average lift (FIG. 16*b*) and maximum lift (FIG. 16*c*). These diagrammes also show the opening retards at low loads that, given the depression created in the engine cylinders and the instantaneous maximum linear speed of the pistons, that make it possible to obtain a high air turbulence and therefore better formation of the air-fuel mixture.

Figure 17:
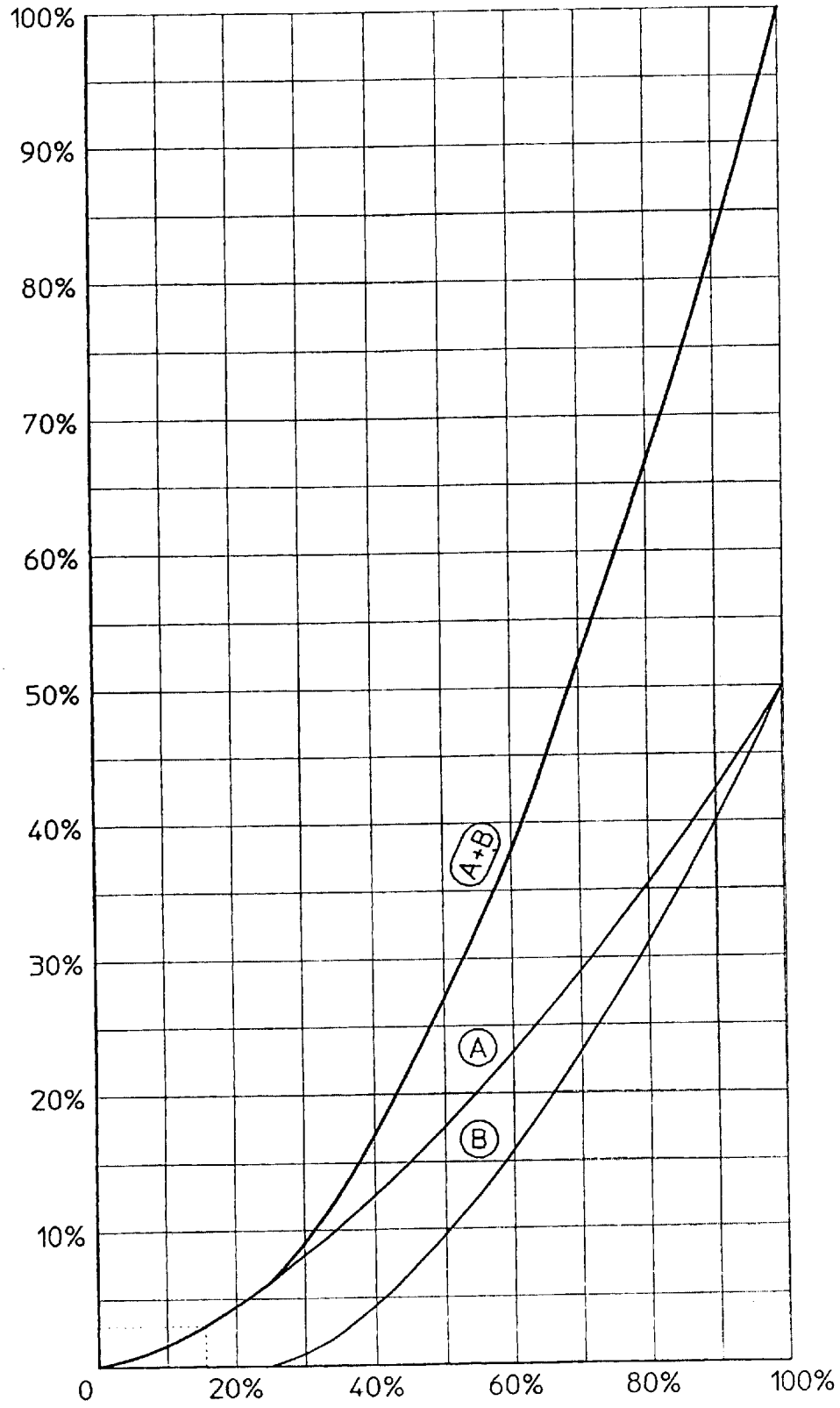
FIGS. 17 and 18 show further diagrammes representative of the timing system in accordance with the invention.

The diagramme in FIG. 17 provides an example of differentiated opening when there are two suction valves and shows the passage areas as functions of the desired angular distance between the appropriate annular elements 4.

Figure 18:
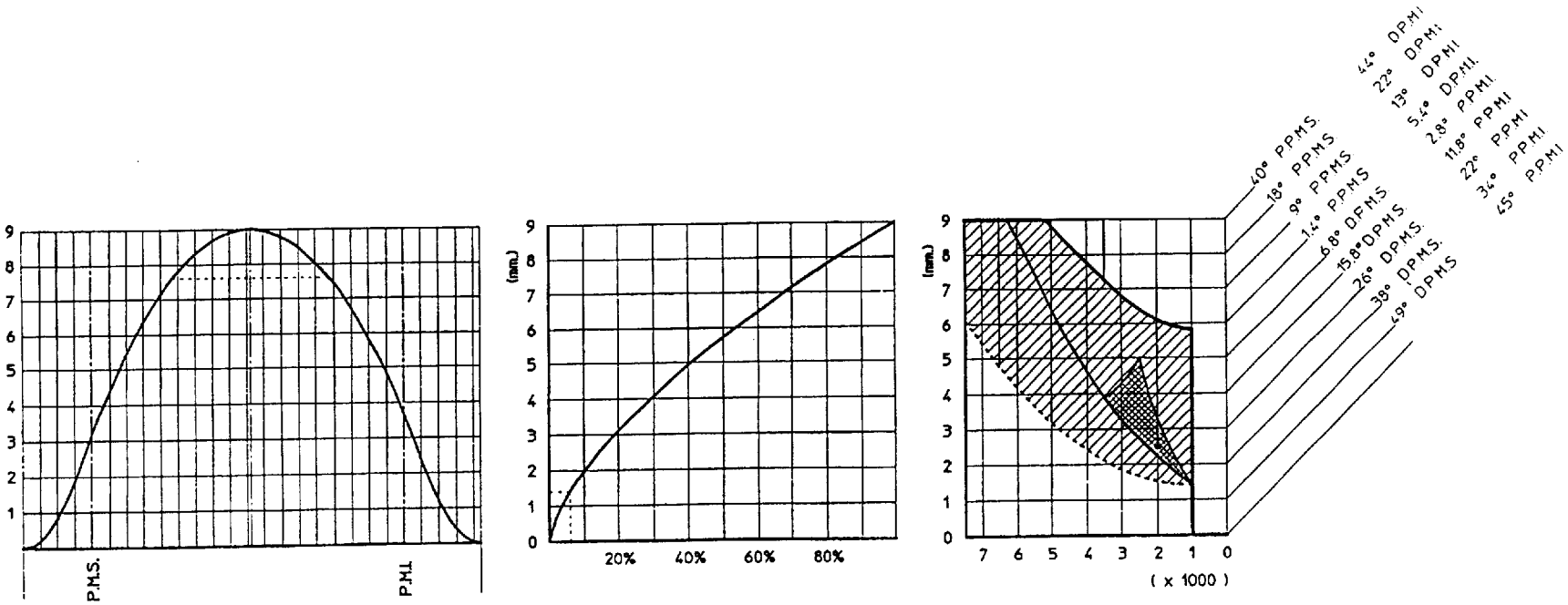

The diagrammes of FIG. 18, again, show an example of possible operating states of the engine that brings out the large operating zone with retarded opening of the suction valves, a feature that goes to the benefit of the anti-pollution factor.

Figure 19:
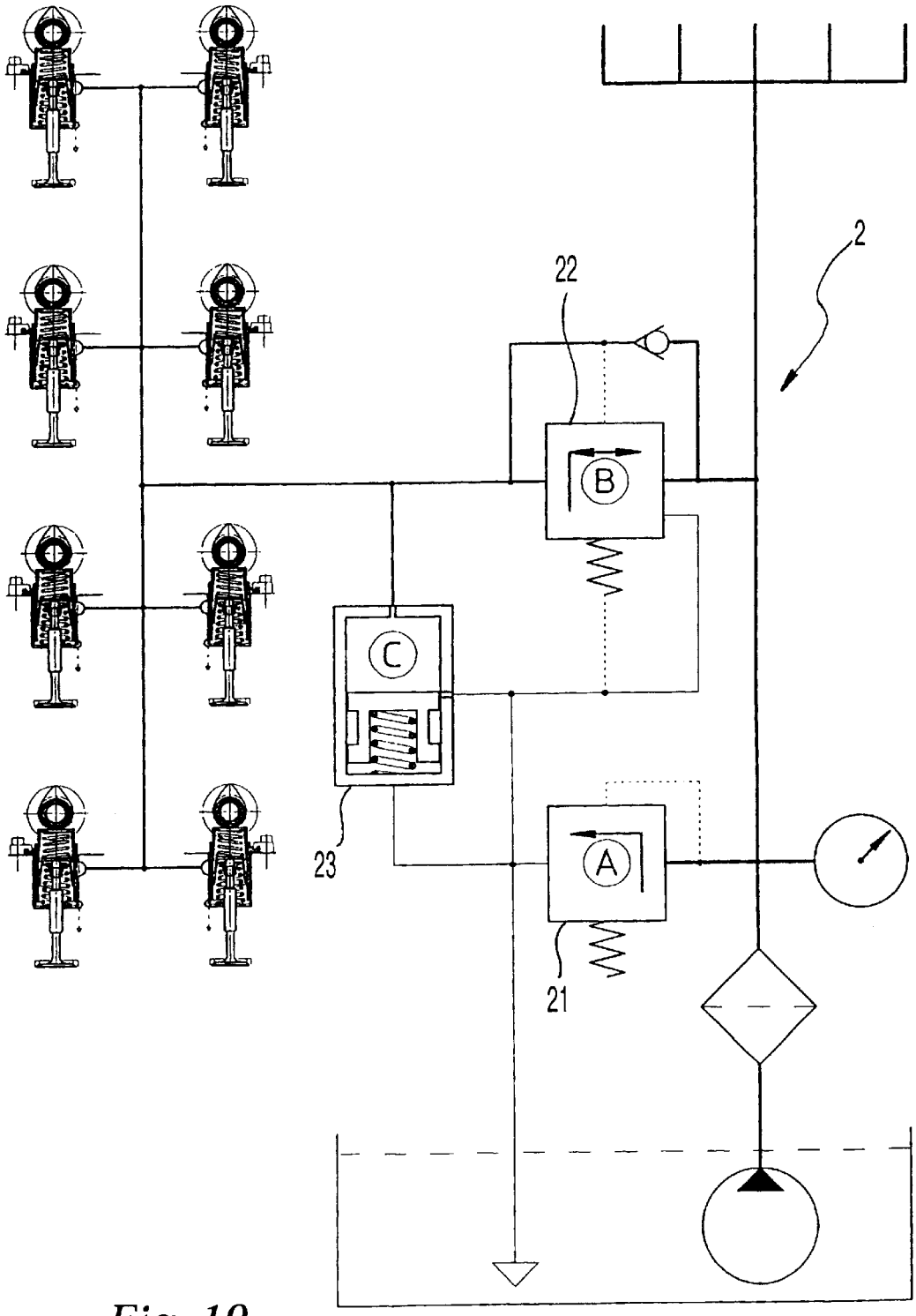
FIG. 19 shows—in diagramme form—a hydraulic circuit that can be used with the timing system in accordance with the invention.

FIG. 19 shows an example of the hydraulic circuit 2 connected with the engine lubrication circuit and comprising not only a maximum pressure valve 21 and a pressure reduction valve 22, but also a small hydraulic accumulator 23 that has the function of damping the pressure peaks.

Figure 20:
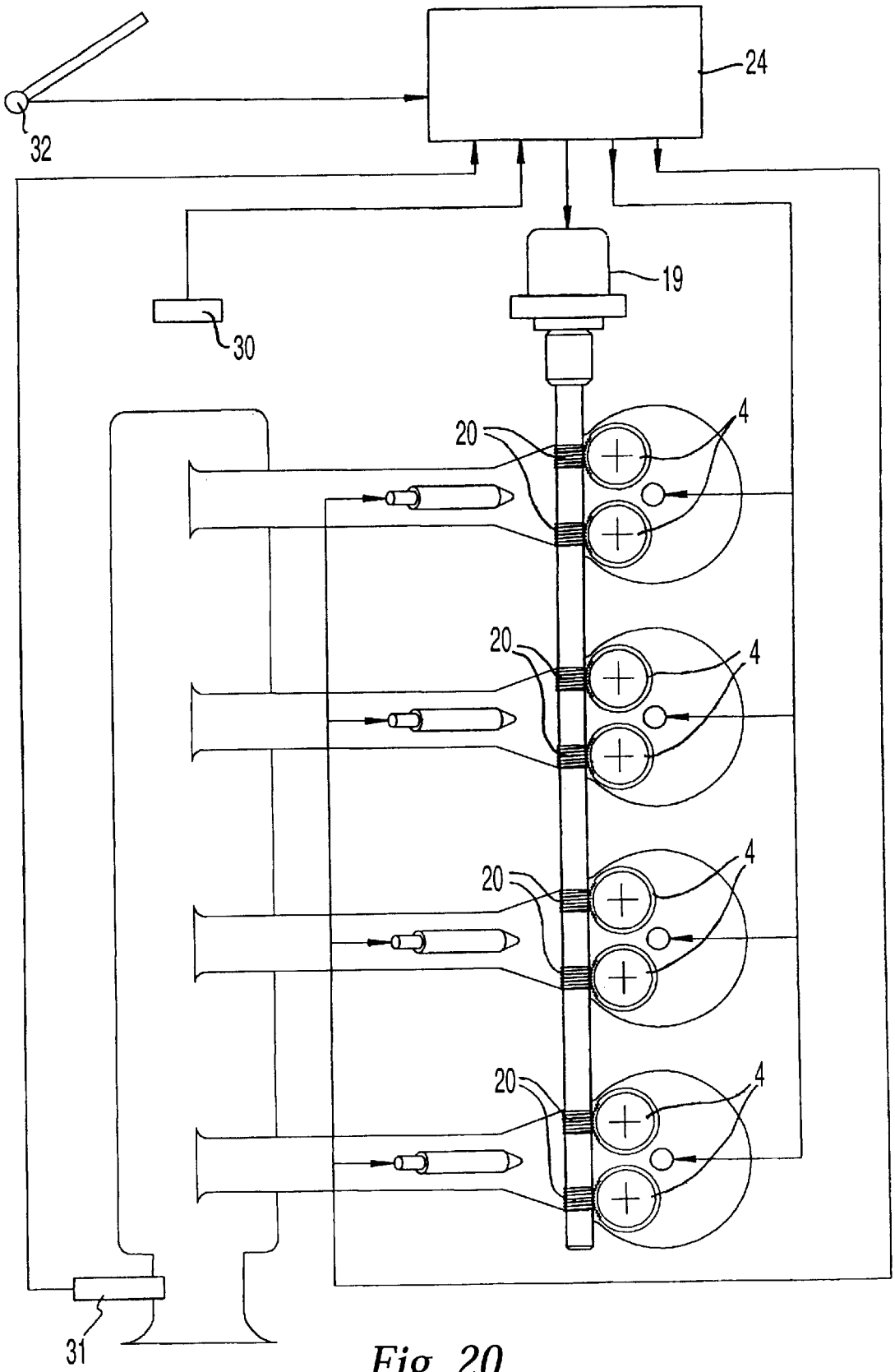
FIG. 20 shows an example of the control pattern of the timing system, again in diagramme form.

Lastly, FIG. 20 shows an example of the layout of the control system, complete with the electric stepper motor 19 controlled by an electronic unit 24 that, with the help of sensors 30, 31 and 32 of, respectively, the rotation regime, the quantity of air sucked in and the required torque (gas pedal), automatically regulates the position of the annular elements 4 associated with the suction and exhaust valves 13 of the engine, controlling also the injection and sparking equipment.

The drawings illustrating some practical possibilities of implementing the invention, the diagrammes and the layouts included in them, represent only some examples and are not to be considered as limitative, because both the construction details and the realization forms could be extensively varied with respect to what has here been described and illustrated, though without in any way overstepping the bounds of the present invention as defined in the claims set out hereinbelow.

Numerous construction variants are in fact possible within the ambit of the invention's general principle as here described and illustrated:

Tappet cup member (8) and valve piston (7): if deemed advantageous, could be designed in such a way as to diminish the quantity of oil contained between them;

Stationary ring (1): if deemed advantageous, could also be eliminated;

Fixed pin (3): could be situated in any other position; could assume any shape; could even be completely eliminated if it were thought to be advantageous to obtain the displacement of the annular element (4) in some manner different from the one here given as an example;

Variation of timing and lift: could be realized also in a discrete manner for two or more fixed positions rather than as a continuous variation, for example by means of an electromagnetic (or some other kind of) planned pulse control;

Return valve: apart from being controlled by the spring (25), could also be hydraulic or pneumatic.

Oil entrance (5) between tappet cup member and piston: could be obtained with holes, ducts or passages of any shape or design.

Annular element (4): the displacement could be obtained also by means of a merely alternating motion, be it axial or rotational. The link with the means that causes its displacement could be of any kind whatsoever.

The control that determines the relative variation of the oil flow could rotatory, alternating or of any other kind, either reversible or irreversible, The management of this control, which has the function of an accelerator, could be mechanical (directly connected to the gas pedal) or enslaved by devises of an electronic, electromagnetic, oleodynamic or any other nature.

The accelerator, operated in the example here illustrated by means of a small electric motor of the stepper type (19), could be provided with a programming system such that—even if the current for sparking the endothermal engine were suddenly to lack—the circuit providing that current could be fed for the time needed to bring the control back into its minimum idling position.

The system can served either from the pressurized oil lubrication circuit of the engine or from an oil circuit of its own.

The aforesaid circuit could be single, double or capable of being hydraulically doubled to permit one of the two branches to be drained (possibly also in an alternative manner so as to maintain all the cylinders in temperature) and therefore, after a number of cycles needed to get the excess oil to seep out of the tappets of the inactive cylinders, running of the engine on less than all the cylinders. Whenever thought to be advantageous, the same result could be obtained with single pressurized oil circuit, but with double tappet control.

ADVANTAGES OF THE INVENTION

The timing system as herein described has the following advantages:

has a cost comparable to that of the present far more limitative phase variators changers;

is not associated with greater power absorption, because it exploits the same pump and the same lubrication circuit as the engine, requiring even a smaller pressure and a discharge only to make up for seepage (this is possible because all the valves are in direct communication and therefore the oil required by one that closes is ceded by another that opens and viceversa;

it does not occupy more space than a conventional engine;

it does not call for any substantial modification of the cylinder heads of the most recent generations, rather, it could even be used with those having timing gear consisting of shafts and rockers;

it does not call for any substantial changes in production and assembly cycles;

it could be industrialized in a very brief space of time;

is has the same reliability as hydraulic tappets;

it is not associated with any response time problems, not even a very high revolution regimes;

it permits direct injection, because the spaces available in the combustion chamber remain exactly the same as those of a conventional engine;

it makes it possible to eliminate the choke valve and, with it, the losses due to pumping at low loads;

in engines with several suction valves, two different helicoidal grooves would make it possible to have different lifts, for example, it would be possible to open just one valve at the minimum and small loads to improve the turbulence and therefore also the combustion efficiency, the specific consumptions and the unburnt hydrocarbons;

with a limited cost increase it could be extended also to the exhaust valves (though, of course, with an opening law different from those of the suction valves, programmable by means of a different shape the said helicoidal groove), thus optimizing also the expansion and scavenging phases, this to the benefit of the torque and the specific consumptions at low loads;

It can be used also to get the engine to run on only some of its cylinders in order to reduce the specific consumption when only a limited power is requires (for example, doubling the feed circuit, with one of the two branches being alternatively discharged to maintain all the cylinders at temperature, setting up an electronic control unit to assure appropriate injection and sparking);

it could be applied also to engines with valves operated by rockers;

it does not call for any modification of the blocks of already existing i.c. motor vehicle engines;

thanks to the radial arrangement of the inlet openings (rather than, for example, a single passage hole) on the mobile annular element, one obtains a low ratio between the volume and the oil passage area and this, in turn, assures:

a laminar oil flow and therefore minimal heating of the oil without increasing the foam formation danger, a low flow speed and, consequently a very low outflow back-pressure (in the system here described with reference to the shown examples the maximum peak of the oil inlet-outlet flow through the circumferential apertures (5), when the gas control is fully released while the engine is revolving at its maximum speed and with the dynamic viscosity of the lubricant not greater than $30.10^{-4}$ Kg.s/sq.m, amounts to about 0.5 bar).

What is claimed is:

1. A timing system for internal combustion engines for motor vehicles, comprising at least one distribution shaft provided with cam means, at least one suction or exhaust valve operated by said cam means, and control means for providing variable lifts and timings of said valve, in which between said cam means and the valve there is arranged a hydraulic tappet including a cup member and a piston delimiting therebetween a chamber that communicates with inlet passage means for feeding oil form a hydraulic circuit, wherein closure of said inlet passage means is performed by said cup member as a result of displacement thereof towards said piston operated by said cam means, and wherein the position of said inlet passage means is selectively regulated to correspondingly vary the moment at which said inlet passage means becomes closed by said cup member and, consequently, retard or advance the opening of said valve to decrease or increase the lift thereof, respectively.

2. A timing system in accordance with claim 1, wherein the position of said inlet passage means can be adjusted in a continuous manner.

3. A timing system in accordance with claim 1, wherein said hydraulic tappet further comprises an annular element displaceable with respect to said chamber and said inlet passage means include a circumferential series of radial apertures provided in said annular element, and said hydraulic tappet further comprising actuator means to control the displacement of said annular element.

4. A timing system in accordance with claim 3, wherein said annular element can be displaced by means of an alternating axial motion.

5. A timing system in accordance with claim 3, wherein said annular element can be displaced by means of an alternating rotary motion.

6. A timing system in accordance with claim 3, wherein said annular element can be displaced by means of an alternating helicoidal motion.

7. A timing system in accordance with claim 3, wherein said actuator means include a mechanism motor-driven via toothed sector on said annular element and a rack.

8. A timing system in accordance with claim 3, wherein said actuator means include a mechanism motor-driven via a toothed sector on said annular element and an endless screw.

9. A timing system in accordance with claim 3, wherein said actuator means are operatively connected directly to an engine gas control.

10. A timing system in accordance with claim 8, wherein said actuator means are electronically controlled.

11. A timing system in accordance with claim 1, wherein said hydraulic circuit includes accumulator means having the function of damping pressure peaks.

12. A timing system in accordance with claim 1, wherein the position of said inlet passage means can be regulated in a discrete manner.

* * * * *